US010280749B2

(12) United States Patent
Chen et al.

(10) Patent No.: US 10,280,749 B2
(45) Date of Patent: May 7, 2019

(54) METHOD FOR DEFORMATION CONTROL OF LARGE-SPAN TUNNEL IN CHLORITE SCHIST STRATUM

(71) Applicant: CHANG'AN UNIVERSITY, Xi'an (CN)

(72) Inventors: Jianxun Chen, Xi'an (CN); Lijun Chen, Xi'an (CN); Yanbin Luo, Xi'an (CN); Pei Huang, Xi'an (CN); Chaoxuan Zhang, Xi'an (CN); Mengen Qin, Xi'an (CN)

(73) Assignee: CHANG'AN UNIVERISTY, Xi'An, Shaanxi (CN)

( * ) Notice: Subject to any disclaimer, the term of this patent is extended or adjusted under 35 U.S.C. 154(b) by 0 days.

(21) Appl. No.: 15/869,545

(22) Filed: Jan. 12, 2018

(65) Prior Publication Data

US 2019/0071968 A1 Mar. 7, 2019

(30) Foreign Application Priority Data

Sep. 5, 2017 (CN) ..... 2017 1 0792178

(51) Int. Cl.
*E21D 11/10* (2006.01)
*E21D 9/14* (2006.01)
*E21D 11/18* (2006.01)

(52) U.S. Cl.
CPC ..... *E21D 11/107* (2013.01); *E21D 11/18* (2013.01); *E21D 9/14* (2013.01)

(58) Field of Classification Search
CPC .. E21D 9/00; E21D 9/001; E21D 9/04; E21D 9/10; E21D 9/14; E21D 11/10; E21D 11/107; E02D 29/045; E02D 29/05
See application file for complete search history.

(56) References Cited

U.S. PATENT DOCUMENTS 7,832,960 B2 * 11/2010 Home ..... E21D 9/001 299/33
2010/0148566 A1 * 6/2010 Home ..... E21D 9/001 299/31

FOREIGN PATENT DOCUMENTS

CN 107448205 A * 12/2017
CN 107725071 A * 2/2018

* cited by examiner

*Primary Examiner* — Frederick L Lagman
(74) *Attorney, Agent, or Firm* — Novick, Kim & Lee, PLLC; Allen Xue

(57) ABSTRACT

A method for deformation control of large-span tunnel in chlorite schist stratum. The method divides the large deformation of large-span tunnel in chlorite schist stratum into five deformation grades according to the surrounding rock conditions of the tunnel. In response to each deformation grade, the deformation control of large-span tunnel is determined so as to ensure the safety and stability of the tunnel support structure and to avoid the clearance intrusion caused by tunnel deformation.

9 Claims, 4 Drawing Sheets

METHOD FOR DEFORMATION CONTROL OF LARGE-SPAN TUNNEL IN CHLORITE SCHIST STRATUM

FIELD

The present application belongs to the field of tunnel engineering technology, and specifically relates to a method for deformation control of large-span tunnel in chlorite schist stratum.

BACKGROUND

Chlorite schist is a regional metamorphic rock with chlorite as its main mineral component, and it has a schistose structure and is water-disintegrable and easy to be softened. Since it belongs to a typical soft rock with low bearing capacity and strong deformation capability, even if it is exposed to be a relatively integral surrounding rock in the early period of tunnel excavation, it will be subject to a large deformation in a short period of time and can hardly be self-stable. If the exposed surrounding rock has poorer integrity, its primary stability can hardly be maintained if direct excavation is carried out, and even a serious collapse will occur in the excavation process, which brings huge difficulties to tunnel construction. Excavation will cause a large range of disturbance to the surrounding rock especially for large-span tunnel such as deep single-hole highway tunnel with three lanes. What's worse, when the ground stress is high, the occurrence of large extrusion deformation is inevitable. If inappropriate measures are adopted, it is easy to cause the damages such as the clearance intrusion of tunnel support deformation, the cracking and spalling of shotcrete, the distortion and fracture of steel frame, the cracking and chipping or even the collapse of secondary lining, and the sinking of side wall, which delays the construction and greatly increases the cost, and the safety is out of control.

Therefore, it is particularly important to reasonably predict the large deformation grade of large-span tunnel in chlorite schist stratum and then adopt corresponding control measures so as to avoid the clearance intrusion caused by tunnel deformation and to ensure the safety of tunnel construction and the stability of the support structure, and the cost is controllable. However, there is no current classification scheme for the large deformation of large-span tunnel in chlorite schist stratum and its corresponding control measures. Therefore, it is necessary to propose the classification scheme for the large deformation and its corresponding control measures on the basis of understanding the physical and mechanical properties of chlorite schist under the different conditions of surrounding rocks by means of the detailed geological investigation, field practice and experimental research.

SUMMARY

In response to the aforesaid technical problem, the present invention provides a method for deformation control of large-span tunnel in chlorite schist stratum. Said method can reasonably predict the large deformation grade of large-span tunnel in chlorite schist stratum under different conditions of surrounding rocks and adopt corresponding control measures to avoid the clearance intrusion caused by tunnel deformation and to ensure the safety and stability of the tunnel support structure, and the cost is controllable.

The present invention is carried out through the following technical solution:

A method for deformation control of large-span tunnel in chlorite schist stratum, and said method divides the large deformation of large-span tunnel in chlorite schist stratum into five deformation grades according to the tunnel surrounding rock conditions. The five large deformation grades are listed as follows: extremely serious large-deformation, serious large-deformation, medium large-deformation, slight large-deformation, and zero large-deformation. And in response to each deformation grade, the present invention determines corresponding control method for the deformation grade of large-span tunnel so as to ensure the safety and stability of the tunnel support structure and to avoid the clearance intrusion caused by tunnel deformation.

Further, the large-span tunnel is single-hole highway tunnel with three lanes, or other tunnels with the same span.

Further, due to the reasons that the large deformation of soft rock tunnel is closely related to the physical and mechanical properties and the ground stress of surrounding rock, the grades of the large deformation of the tunnel and the pressures of surrounding rock are different under different surrounding rock conditions (including the main mineral components of chlorite schist, rock mass strength, rock mass integrity and groundwater condition, etc.). It is obviously unreasonable to adopt the same control measure for the different large deformation. Therefore, the division of large deformation grades for taking corresponding control measures is very necessary to guide the design, construction and management of large-span tunnel in chlorite schist stratum effectively.

The tunnel surrounding rock condition of the extremely serious large-deformation is: the tunnel surrounding rock is composed of single chlorite schist, and its saturated uniaxial compressive strength Rc<5 MPa, and it is in a powder or granular structure.

The tunnel surrounding rock condition of the serious large-deformation is: the tunnel surrounding rock is composed of chlorite schist and contains a small amount of quartz veins with the content less than 20%; it also has underground water, and its saturated uniaxial compressive strength of rock mass Rc=5-10 MPa, and its rock mass integrity coefficient Kv≤0.15, and it is in a cataclastic or granular structure.

The tunnel surrounding rock condition of the medium large-deformation is: the tunnel surrounding rock is composed of chlorite schist and contains a small amount of quartz veins with the content less than 20%; it has no underground water, and its saturated uniaxial compressive strength of rock mass Rc=10-20 MPa, and its rock mass integrity coefficient Kv is 0.15-0.35, and it is in a thin stratified structure with a layer thickness less than 10 cm or a cataclastic structure.

The tunnel surrounding rock condition of the slight large-deformation is: the tunnel surrounding rock is composed of chlorite schist and contains large quartz veins with particle size greater than 5 cm; it has no underground water, and its saturated uniaxial compressive strength of rock mass Rc=20-25 MPa, and its rock mass integrity coefficient Kv is 0.35-0.55, and it is in a thick stratified structure with a layer thickness greater than 10 cm or a blocky structure.

The tunnel surrounding rock condition of the zero large-deformation is: the tunnel surrounding rock is chlorite albite schist or other stratum with chlorite as its main part; it has no underground water, and its saturated uniaxial compressive strength of rock mass Rc≥25 MPa, and its rock mass integrity coefficient Kv is 0.55-0.75, and it is in a blocky structure.

Further, for each deformation grade, the corresponding control measure for the deformation of large-span tunnel comprises the following steps according to the construction process: construct advance support, set reserved deformation, excavate the tunnel, construct primary support, and construct secondary lining.

Further, the method controls the deformation of large-span tunnel with different deformation grades to ensure the safety and stability of the tunnel support structure through controlling: the row number of advance grouting pipe; the reserved deformation; the depth of the tunnel invert, i.e., the distance from the bottom of the invert to the top surface of the invert backfill; the type of the steel frame and its interval; as well as the reserved deformation for each layer steel frame, the diameter and quantity of feet-lock pipes, and the thickness of shotcrete and secondary lining concrete of each layer of steel frames.

Further, the specific control measure for extremely serious large-deformation of large-span tunnel is:

Construct advance support: carrying out advance support by using double-row advance grouting pipe;

Set reserved deformation: set the value of reserved deformation to be 90-120 cm;

Excavate the tunnel: excavating the tunnel by the method of three steps with reserving core soil;

when the tunnel invert is excavated, the distance from the bottom of the tunnel invert to the top surface of invert backfill is 3-4 m, which can improve the stress condition of the tunnel invert and effectively prevent the cracking and heave of the tunnel invert;

Construct primary support: double-layer primary supports are carried out in turn for the arch, side wall and invert of the tunnel, wherein the reserved deformation for the first-layer primary support is 90-120 cm, and the second-layer primary support is carried out when the reserved deformation has a remaining of 45-60 cm; and each layer of primary support uses HK200b-type steel frame with an interval of 50-60 cm and shotcrete with a thickness of 26-30 cm, and each layer of steel frame is installed with a double-layer steel mesh; and the arch foot and the wall foot of the upper, middle and lower steps of the first-layer steel frame are set with small-diameter double-row feet-lock pipes with a diameter ≤50 mm; and a large-diameter feet-lock pipe with a diameter ≥89 mm is set for each steel frame of the second layer at the arch foot and the wall foot of the middle and lower steps. Since the middle and lower steps of the second-layer steel frame have a larger construction space, large-diameter feet-lock pipes can be installed there for better settlement control effect; and the installation angle of the feet-lock pipe is 20°-50°; and the method of large reserved deformation+double-layer primary supports+carrying out supports in turn can meet the requirement of large deformation of the tunnel and is beneficial to prevent the clearance intrusion caused by tunnel deformation on the one hand, and on the other hand, the double-layer primary supports can be used for strong support to avoid the damage to the support structure due to lack of strength; moreover, by carrying out supports in turn, that is, the construction of taking the first-layer primary support as a stress release layer to release a part of surrounding rock stress before the second-layer primary support is carried out, one can effectively reduce the surrounding rock pressure on the support structure, and the surrounding rock behind the support structure can be compacted continuously, and thus the bearing capacity of the surrounding rock can be improved, and eventually the large tunnel deformation is under control, and one can achieve the purpose that the deformed tunnel causes no clearance intrusion and thus no supports need to be demolished and reconstructed;

Construct secondary lining: the secondary lining uses reinforced concrete with a thickness of 70-90 cm at the arch and the side wall, and reinforced concrete with a thickness of 70-100 cm in the tunnel invert.

Further, the specific control measure for serious large-deformation of large-span tunnel is:

Construct advance support: carrying out advance support by using double-row advance grouting pipe;

Set reserved deformation: set the value of reserved deformation to be 50-90 cm;

Excavate the tunnel: excavating the tunnel by the method of three steps with reserving core soil; when the tunnel invert is excavated, the distance from the bottom of the tunnel invert to the top surface of invert backfill is 3-4 m, which can improve the stress condition of the tunnel invert and effectively prevent the cracking and heave of the tunnel invert;

Construct primary support: double-layer primary supports are carried out in turn for the arch and side wall of the tunnel, wherein the the reserved deformation for the first-layer primary support is is 50-90 cm, and the second-layer primary support is carried out when the reserved deformation has a remaining of 25-45 cm; and single-layer primary support is applied to the tunnel invert; and each layer of primary support uses HK200b-type steel frame with an interval of 60-70 cm and shotcrete with a thickness of 26-30 cm, and each layer of steel frame is installed with a double-layer steel mesh; and the arch foot and the wall foot of the upper, middle and lower steps of the first-layer steel frame are set with small-diameter double-row feet-lock pipes with a diameter ≤50 mm; and a large-diameter feet-lock pipe with a diameter ≥89 mm is installed for every two steel frames of the second layer at the arch foot and the wall foot of the middle and lower steps. Since the middle and lower steps of the second-layer steel frame have a larger construction space, large-diameter feet-lock pipes can be installed there for better settlement control effect; and the installation angle of the feet-lock pipe is 20°-50°; in the early period of tunnel excavation, since the surrounding rock is relatively dense, it is difficult to achieve effective grouting reinforcement to the surrounding rock, and when the second-layer steel frame is set, the compactness of the surrounding rock has changed greatly compared with that in the early excavation period; therefore, when the second-layer primary support is finished, the grouting pipe is used to carry out the radial grouting; and the aforesaid method of large reserved deformation+double-layer primary supports+carrying out supports in turn can meet the requirement of large deformation of the tunnel and is beneficial to prevent the clearance intrusion caused by tunnel deformation on the one hand, and on the other hand, the double-layer primary supports can be used for strong support to avoid the damage to the support structure due to lack of strength; moreover, by carrying out supports in turn, that is, the construction of taking the first-layer primary support as a stress release layer to release a part of surrounding rock stress before the second-layer primary support is carried out, one can effectively reduce the surrounding rock pressure on the support structure, and the surrounding rock behind the support structure can be compacted continuously, and thus the bearing capacity of the surrounding rock can be improved, and eventually the large tunnel deformation is under control, and one can achieve the purpose that the deformed tunnel causes no clearance intrusion and thus no support needs to be demolished and reconstructed;

Construct secondary lining: the secondary lining uses reinforced concrete with a thickness of 70-90 cm at the arch and the side wall, and reinforced concrete with a thickness of 70-100 cm in the tunnel invert.

Further, the specific control measure for medium large-deformation of large-span tunnel is:

Construct advance support: carrying out advance support by using double-row advance grouting pipe;

Set reserved deformation: set the value of reserved deformation to be 30-50 cm;

Excavate the tunnel: excavating the tunnel by the method of three steps with reserving core soil; when the tunnel invert is excavated, the distance from the bottom of the tunnel invert to the top surface of invert backfill is 3-4 m, which can improve the stress condition of the tunnel invert and effectively prevent the cracking and heave of the tunnel invert;

Construct primary support: double-layer primary supports are carried out in turn for the arch and side wall of the tunnel, wherein the the reserved deformation for the first-layer primary support is 30-50 cm, and the second-layer primary support is carried out when the reserved deformation has a remaining of 15-25 cm; and single-layer primary support is applied to the tunnel invert; and each layer of primary support uses HW175-type steel frame with an interval of 70-80 cm and shotcrete with a thickness of 26-30 cm, and each layer of steel frame is installed with a double-layer steel mesh; and the arch foot and the wall foot of the upper, middle and lower steps of the first-layer steel frame are set with small-diameter double-row feet-lock pipes with a diameter ≤ 50 mm; and a large-diameter feet-lock pipe with a diameter ≥ 89 mm is installed for every two steel frames of the second layer at the arch foot and the wall foot of the middle and lower steps. Since the middle and lower steps of the second-layer steel frame have a larger construction space, large-diameter feet-lock pipes can be installed there for better settlement control effect; and the installation angle of the feet-lock pipe is 20°-50°; in the early period of tunnel excavation, since the surrounding rock is relatively dense, it is difficult to achieve effective grouting reinforcement to the surrounding rock, and when the second-layer steel frame is set, the compactness of the surrounding rock has changed greatly compared with that in the early excavation period; therefore, when the second-layer primary support is finished, the grouting pipe is used to carry out the radial grouting; and the aforesaid method of large value of reserved deformation+double-layer primary supports+carrying out supports in turn can meet the requirement of large deformation of the tunnel and is beneficial to prevent the clearance intrusion caused by tunnel deformation on the one hand, and on the other hand, the double-layer primary supports can be used for strong support to avoid the damage to the support structure due to lack of strength; moreover, by carrying out supports in turn, that is, the construction of taking the first-layer primary support as a stress release layer to release a part of surrounding rock stress before the second-layer primary support is carried out, one can effectively reduce the surrounding rock pressure on the support structure, and the surrounding rock behind the support structure can be compacted continuously, and thus the bearing capacity of the surrounding rock can be improved, and eventually the large tunnel deformation is under control, and one can achieve the purpose that the deformed tunnel causes no clearance intrusion and thus no supports need to be demolished and reconstructed;

Construct secondary lining: the secondary lining uses reinforced concrete with a thickness of 70-90 cm at the arch, the side wall and the invert of the tunnel.

Further, the specific control measure for slight large-deformation of large-span tunnel is:

Construct advance support: carrying out advance support by using double-row advance grouting pipe;

Set reserved deformation: set the value of reserved deformation to be 20-30 cm;

Excavate the tunnel: excavating the tunnel by the method of three steps with reserving core soil; when the tunnel invert is excavated, the distance from the bottom of the tunnel invert to the top surface of invert backfill is 2.5-3 m, which can improve the stress condition of the tunnel invert and effectively prevent the cracking and heave of the tunnel invert;

Construct primary support: single-layer primary support is carried out for the arch, side wall and invert of the tunnel, wherein the primary support uses HK200b-type steel frame with an interval of 80-90 cm and shotcrete with a thickness of 26-30 cm, and the steel frame is set with a double-layer steel mesh; and the arch foot and the wall foot of the upper, middle and lower steps of the steel frame are set with small-diameter double-row feet-lock pipes with a diameter ≤ 50 mm, and the installation angle of the feet-lock pipe is 20°-50°; as for the replaced or twisted part of the steel frame, the grouting pipe is used to carry out radial grouting reinforcement to the surrounding rock;

Construct secondary lining: the secondary lining uses reinforced concrete with a thickness of 60-80 cm at the arch, the side wall and the invert of the tunnel.

Further, the specific control measure for zero large-deformation of large-span tunnel is:

Construct advance support: carrying out advance support by using double-row advance grouting pipe;

Set reserved deformation: set the value of reserved deformation to be 10-20 cm;

Excavate the tunnel: excavating the tunnel by the method of three steps with reserving core soil;

Construct primary support: single-layer primary support is carried out for the arch, side wall and invert of the tunnel, wherein the primary support uses HW175-type steel frame with an interval of 90-100 cm and shotcrete with a thickness of 26-28 cm, and the steel frame is set with a double-layer steel mesh; and the arch foot and the wall foot of the upper, middle and lower steps of the steel frame are set with small-diameter double-row feet-lock pipes with a diameter ≤ 50 mm, and the installation angle of the feet-lock pipe is 20°-50°;

Construct secondary lining: the secondary lining uses reinforced concrete with a thickness of 60-80 cm at the arch, the side wall and the invert of the tunnel.

The beneficial technical effects of the present invention are:

There is no current classification scheme for the large deformation of large-span tunnel in chlorite schist stratum and its corresponding control measures so that the tunnel design and construction have certain blindness. As a result, it is vulnerable to the damages such as the clearance intrusion of tunnel support deformation, the cracking and spalling of shotcrete, the distortion and fracture of steel frame, the cracking and chipping or even the collapse of secondary lining, and the sinking of side wall. The method of the present invention can reasonably predict the large deformation grade of large-span tunnel in chlorite schist stratum according to the condition of the surrounding rock and adopt corresponding measures to effectively control the large deformation of the tunnel.

The method of the present invention provides the classification scheme for the large deformation of large-span tunnel in chlorite schist stratum and its corresponding control measures based on the consideration of the surrounding rock conditions (including the main mineral components of chlorite schist, rock mass strength, rock mass integrity and underground water condition, etc.), the large deformation grades and the effects of the control measures in the construction site.

During the construction process of chlorite schist large-span tunnel in the future, one can refer to the classification scheme for large deformation of the present invention to predict the large deformation grade of the tunnel so as to carry out corresponding deformation control measure and avoid the clearance intrusion caused by tunnel deformation and to ensure the safety and stability of the tunnel support structure, and the cost is also controllable.

DRAWING REFERENCES

Figure 1:
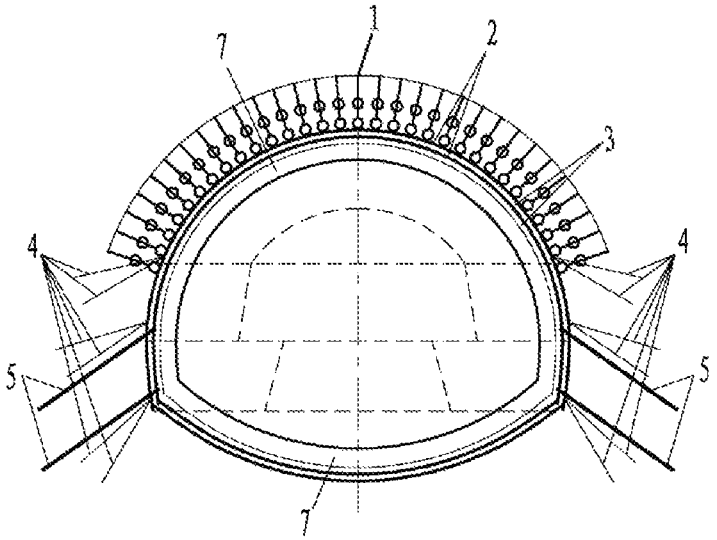
FIG. 1 is a diagram of corresponding tunnel support structure of extremely serious large-deformation grade.

1. advance grouting pipe; 2. HK200b-type steel frame; 3. C25 shotcrete; 4. Φ50 mm feet-lock pipe; 5. Φ108 mm feet-lock pipe; 6. connection steel plate; 7. C35 reinforced concrete; 8. HW175-type steel frame; 9. Φ89 mm feet-lock pipe; 10. C30 reinforced concrete.

DETAILED DESCRIPTION OF THE FIGURES

In order to make the purpose, technical solution and advantages of the present invention clearer, the present invention is further described in detail through the drawings and the embodiments. It should be understood that the concrete embodiments as described herein are only used to explain the present invention instead of defining the present invention.

To the contrary, the present invention covers any substitute, modification, equivalent method, and solution that are defined by the claims within the essence and scope of the present invention. Further, in order to make the public have a better understanding of the present invention, some specific details are described in the details in the present invention described below. And those skilled in the art can completely understand the present invention even if there is no description of these details.

Example 1

The present example provides a method for deformation control of large-span tunnel in chlorite schist stratum, and said method divides the large deformation of large-span tunnel in chlorite schist stratum into five deformation grades according to the surrounding rock conditions of the tunnel (including the main mineral components of chlorite schist, density, rock mass strength, rock mass integrity, rock mass discontinuity occurrence and underground water condition, etc.) in combination with the large deformation grades and the controlling effects of the large deformation under different conditions of the surrounding rock in the tunnel site. The five large deformation grades are listed from the highest to the lowest degree of deformation: extremely serious large-deformation, serious large-deformation, medium large-deformation, slight large-deformation, and zero large-deformation. And the present invention determines corresponding method for the deformation control of large-span tunnel in response to each deformation grade so as to ensure the safety and stability of the tunnel support structure and to avoid the clearance intrusion caused by tunnel deformation.

The tunnel surrounding rock condition of the extremely serious large-deformation is: the tunnel surrounding rock is composed of single chlorite schist, and its saturated uniaxial compressive strength Rc<5 MPa, and it is in a powder or granular structure.

The tunnel surrounding rock condition of the serious large-deformation is: the tunnel surrounding rock is composed of chlorite schist and contains a small amount of quartz veins with the content less than 20%; it also has underground water, and its saturated uniaxial compressive strength of rock mass Rc=5-10 MPa, and its rock mass integrity coefficient Kv≤0.15, and it is in a cataclastic or granular structure.

The tunnel surrounding rock condition of the medium large-deformation is: the tunnel surrounding rock is composed of chlorite schist and contains a small amount of quartz veins with the content less than 20%; it has no underground water, and its saturated uniaxial compressive strength of rock mass Rc=10-20 MPa, and its rock mass integrity coefficient Kv is 0.15-0.35, and it is in a thin stratified structure with a layer thickness less than 10 cm or a cataclastic structure.

The tunnel surrounding rock condition of the slight large-deformation is: the tunnel surrounding rock is composed of chlorite schist and contains large quartz veins with particle size greater than 5 cm; it has no underground water, and its saturated uniaxial compressive strength of rock mass Rc=20-25 MPa, and its rock mass integrity coefficient Kv is 0.35-0.55, and it is in a thick stratified structure with a layer thickness greater than 10 cm or a blocky structure.

The tunnel surrounding rock condition of the zero large-deformation is: the tunnel surrounding rock is chlorite albite schist or other stratum with chlorite as its main part; it has no underground water, and its saturated uniaxial compressive strength of rock mass Rc≥25 MPa, and its rock mass integrity coefficient Kv is 0.55-0.75, and it is in a blocky structure.

Further, the large-span tunnel is single-hole highway tunnel with three lanes, or other tunnels with the same span.

Figure 2:
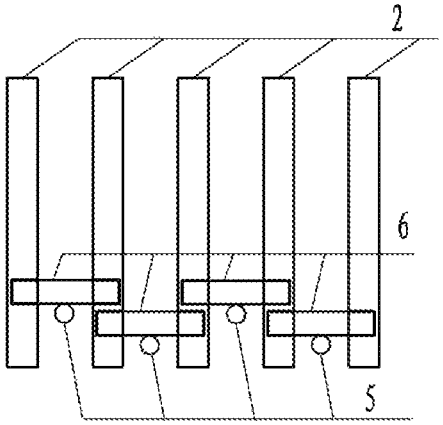
FIG. 2 is the arrangement diagram of Φ108 mm feet-lock pipe in extremely serious large-deformation grade.

When the large deformation grade of large-span tunnel in chlorite schist stratum is extremely serious large-deformation, as shown in FIG. 1, the corresponding control measure for extremely serious large-deformation is:

Construct advance support: carrying out advance support by using Φ50 double-row advance grouting pipe 1 with a length of 3.5 m and a circumferential space of 40 cm;

Set reserved deformation: set the value of reserved deformation to be 90-120 cm;

Excavate the tunnel: excavating the tunnel by the method of three steps with reserving core soil; in order to improve the stress condition of the tunnel invert, the distance from the bottom of the tunnel invert to the top surface of invert backfill is 3-4 m;

Construct primary support: double-layer primary supports are carried out in turn for the arch, side wall and invert of the tunnel, that is, carry out the first-layer primary support and then the second-layer primary support when the reserved deformation has a remaining of 45-60 cm; and the first-layer steel frame and the second-layer steel frame in the double-layer primary supports use HK200b-type steel frame 2 with an interval of 50 cm, and each layer of steel frame is installed with a double-layer Φ8 steel mesh with the mesh space of 20×20 cm; and the first layer of shotcrete and the second layer of shotcrete are made of C25 shotcrete 3 with a thickness of 28 cm; and double-row Φ50 feet-lock pipes 4 with a length of 4 m are installed at the arch foot and the wall foot of the upper, middle and lower steps for the first-layer steel frame, and each truss of steel frame is installed with 24 feet-lock pipes; Φ108 feet-lock pipe 5 with a length of 6 m is set for each steel frame of the second layer at the arch foot and the wall foot of the middle and lower steps, as shown in FIG. 2 for the specific arrangement diagram, and a connection steel plate 6 with a thickness of 20 mm is welded firmly with the two neighboring steel frames so as to support the second-layer steel frame by Φ108 feet-lock pipe 5; and the installation angle of the aforesaid feet-lock pipe is 20°-50°;

Construct secondary lining: the secondary lining is made of C35 reinforced concrete 7 with a thickness of 80 cm at the arch and the side wall, and the thickness of the secondary lining in the tunnel invert is 100 cm, and the rebar in the reinforced concrete uses Φ28 rebar as the main reinforcement, and the space is 20 cm.

When the large deformation grade of large-span tunnel in chlorite schist stratum is extremely serious large-deformation, the aforesaid control measure can be used to avoid the clearance intrusion caused by tunnel deformation and to ensure the safety and stability of the tunnel support structure, and the cost is controllable.

Figure 3:
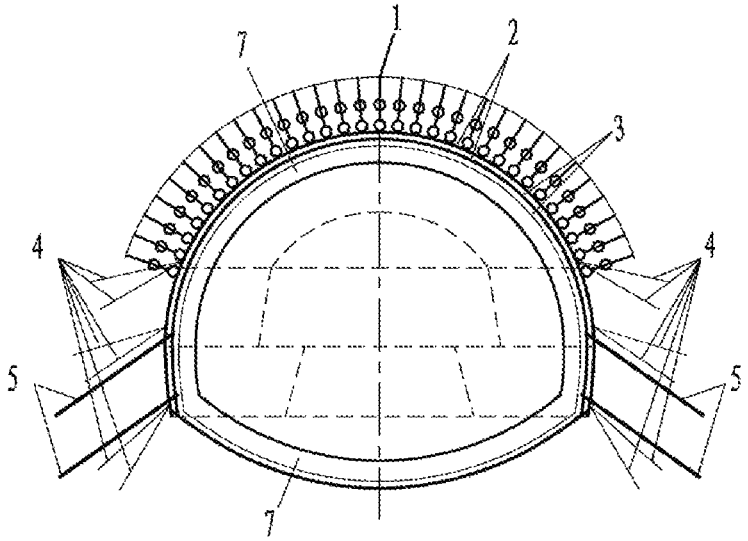
FIG. 3 is a diagram of corresponding tunnel support structure of serious large-deformation grade.
Figure 4:
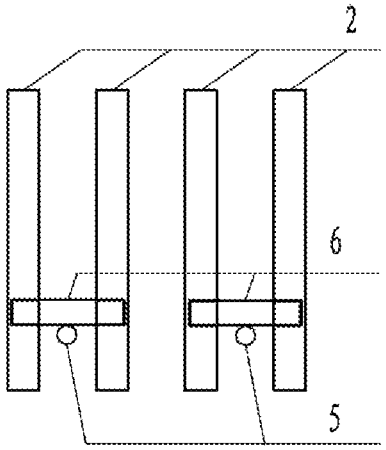
FIG. 4 is the arrangement diagram of Φ108 mm feet-lock pipe in serious large-deformation grade.

When the large deformation grade of large-span tunnel in chlorite schist stratum is serious large-deformation, as shown in FIG. 3, the corresponding control measure for serious large-deformation is:

Construct advance support: carrying out advance support by using Φ50 double-row advance grouting pipe 1 with a length of 3.5 m and a circumferential space of 40 cm;

Set reserved deformation: set the value of reserved deformation to be 50-90 cm;

Excavate the tunnel: excavating the tunnel by the method of three steps with reserving core soil; in order to improve the stress condition of the tunnel invert, the distance from the bottom of the tunnel invert to the top surface of invert backfill is 3-4 m;

Construct primary support: double-layer primary supports are carried out in turn for the arch and side wall of the tunnel, that is, carry out the first-layer primary support and then the second-layer primary support when the reserved deformation has a remaining of 25-45 cm; and the single-layer primary support is used in the tunnel invert; the first-layer steel frame and the second-layer steel frame at the arch and side wall in the double-layer primary supports use HK200b-type steel frame 2 with an interval of 60 cm, and each layer of steel frame is installed with a double-layer Φ8 steel mesh with the mesh space of 20×20 cm; and the first layer of shotcrete and the second layer of shotcrete at the arch and side wall are made of C25 shotcrete 3 with a thickness of 28 cm; and the parameters of primary support in the tunnel invert are the same with the parameters of the single-layer primary support at the arch and the side wall; and double-row Φ50 feet-lock pipes 4 with a length of 4 m are installed at the arch foot and the wall foot of the upper, middle and lower steps for the first-layer steel frame, and each truss of steel frame is installed with 24 feet-lock pipes; Φ108 mm feet-lock pipe 5 with a length of 6 m is installed for every two steel frames of the second layer at the arch foot and the wall foot of the middle and lower steps, as shown in FIG. 4 for the specific arrangement diagram, and a connection steel plate 6 with a thickness of 20 mm is welded firmly with the two neighboring steel frames so as to support the second-layer steel frame by Φ108 feet-lock pipe 5; and the installation angle of the aforesaid feet-lock pipe is 20°-50°; when the second-layer primary support is done, Φ50 grouting pipe with a length of 4 m and a space of 1.5×1.5 m is used to carry out radial grouting reinforcement to the surrounding rock;

Construct secondary lining: the secondary lining is made of C35 reinforced concrete 7, and the thickness of the secondary lining at the arch and side wall is 80 cm, and the secondary lining 22 in the tunnel invert is made of C35 reinforced concrete with a thickness of 100 cm, and the rebar in the secondary lining uses Φ28 rebar as the main reinforcement, and the space is 20 cm.

When the large deformation grade of large-span tunnel in chlorite schist stratum is serious large-deformation, the aforesaid control measure can be used to avoid the clearance intrusion caused by tunnel deformation and to ensure the safety and stability of the tunnel support structure, and the cost is controllable.

Figure 5:
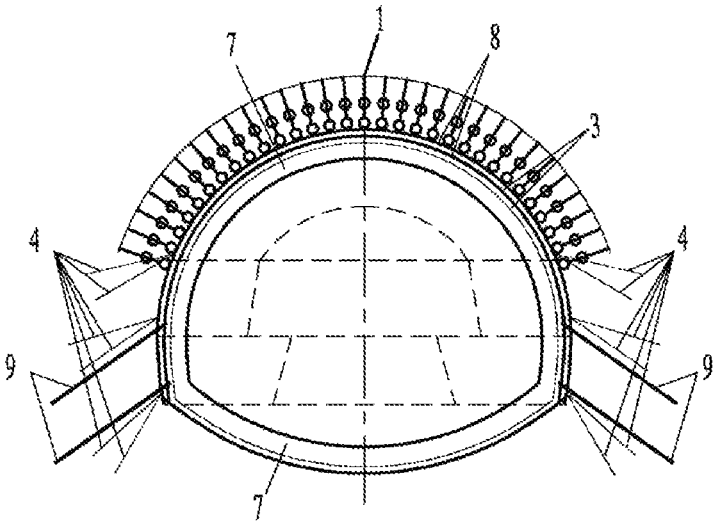
FIG. 5 is a diagram of corresponding tunnel support structure of medium large-deformation grade.
Figure 6:
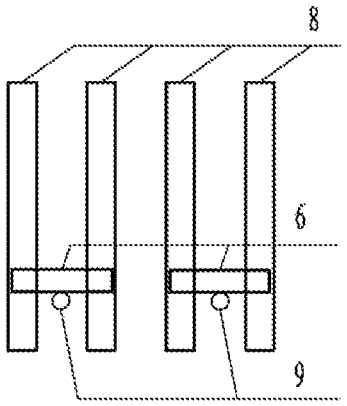
FIG. 6 is the arrangement diagram of Φ89 mm feet-lock pipe in medium large-deformation grade.

When the large deformation grade of large-span tunnel in chlorite schist stratum is medium large-deformation, as shown in FIG. 5, the corresponding control measure for medium large-deformation is:

Construct advance support: carrying out advance support by using Φ50 double-row advance grouting pipe 1 with a length of 3.5 m and a circumferential space of 40 cm;

Set reserved deformation: set the value of reserved deformation to be 30-50 cm;

Excavate the tunnel: excavating the tunnel by the method of three steps with reserving core soil; in order to improve the stress condition of the tunnel invert, the distance from the bottom of the tunnel invert to the top surface of invert backfill is 3-4 m;

Construct primary support: double-layer primary supports are carried out in turn for the arch and side wall of the tunnel, that is, carry out the first-layer primary support and then the second-layer primary support when the reserved deformation has a remaining of 15-25 cm; and the single-layer primary support is used in the tunnel invert; the first-layer steel frame and the second-layer steel frame at the arch and side wall in the double-layer primary supports use HW175-type steel frame 8 with an interval of 80 cm, and each layer of steel frame is installed with a double-layer Φ8 steel mesh with the mesh space of 20×20 cm; and the first layer of shotcrete and the second layer of shotcrete at the arch and side wall are made of C25 shotcrete 3 with a thickness of 28 cm; and the parameters of primary support in the tunnel invert are the same with the parameters of the single-layer primary support at the arch and the side wall; and double-row Φ50 feet-lock pipes 4 with a length of 4 m are installed at the arch foot and the wall foot of the upper, middle and lower steps for the first-layer steel frame, and each truss of steel frame is installed with 24 feet-lock pipes; Φ89 feet-lock pipe 9 with a length of 6 m is installed for every two steel frames of the second layer at the arch foot and the wall foot of the middle and lower steps, as shown in FIG. 6 for the specific arrangement diagram, and a connection steel plate 6 with a thickness of 20 mm is welded firmly with the two neighboring steel frames so as to support the second-layer steel frame by Φ89 feet-lock pipe 9; when the second-layer primary support is done, Φ50 grouting pipe with a length of 4 m and a space of 1.5×1.5 m is used to carry out radial grouting reinforcement to the surrounding rock;

Construct secondary lining: the secondary lining is made of C35 reinforced concrete 7, and the thickness of the secondary lining at the arch, side wall and tunnel invert is 80 cm, and the rebar in the secondary lining uses Φ28 rebar as the main reinforcement, and the space is 20 cm.

When the large deformation grade of large-span tunnel in chlorite schist stratum is medium large-deformation, the aforesaid control measure can be used to avoid the clearance intrusion caused by tunnel deformation and to ensure the safety and stability of the tunnel support structure, and the cost is controllable.

Figure 7:
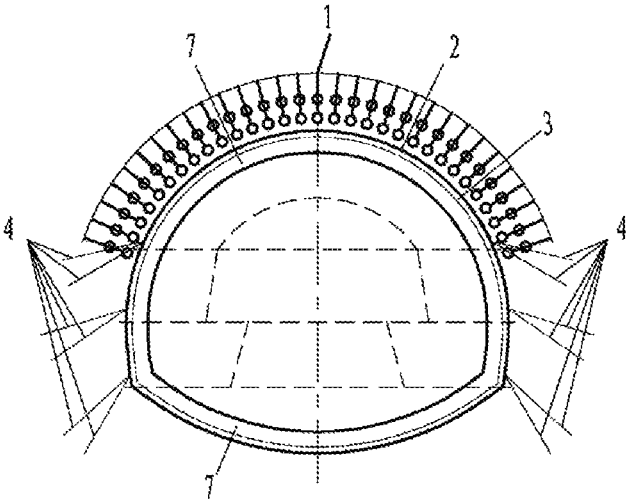
FIG. 7 is a diagram of corresponding tunnel support structure of slight large-deformation grade.

When the large deformation grade of large-span tunnel in chlorite schist stratum is slight large-deformation, as shown in FIG. 7, the corresponding control measure for slight large-deformation is:

Construct advance support: carrying out advance support by using Φ50 double-row advance grouting pipe 1 with a length of 3.5 m and a circumferential space of 40 cm;

Set reserved deformation: set the value of reserved deformation to be 20-30 cm;

Excavate the tunnel: excavating the tunnel by the method of three steps with reserving core soil; in order to improve the stress condition of the tunnel invert, the distance from the bottom of the tunnel invert to the top surface of invert backfill is 2.5-3 m;

Construct primary support: the arch, single-layer primary support is carried out for the arch, side wall and invert of the tunnel, wherein the primary support uses HK200b-type steel frame 2 with an interval of 80 cm and C25 shotcrete 3 with a thickness of 28 cm, and the steel frame is set with a double-layer Φ8 steel mesh with the mesh space of 20×20 cm; and double-row Φ50 feet-lock pipes 4 with a length of 4 m are installed at the arch foot and the wall foot of the upper, middle and lower steps, and each truss of steel frame is installed with 24 feet-lock pipes; as for the replaced or twisted part of the steel frame, Φ50 grouting pipe with a length of 4 m and a space of 1.5×1.5 m is used to carry out radial grouting reinforcement to the surrounding rock;

Construct secondary lining: the secondary lining is made of C35 reinforced concrete 7, and the thickness of the secondary lining at the arch, side wall and tunnel invert is 70 cm, and the rebar in the secondary lining uses Φ25 rebar as the main reinforcement, and the space is 20 cm.

When the large deformation grade of large-span tunnel in chlorite schist stratum is slight large-deformation, the aforesaid control measure can be used to avoid the clearance intrusion caused by tunnel deformation and to ensure the safety and stability of the tunnel support structure, and the cost is controllable.

Figure 8:
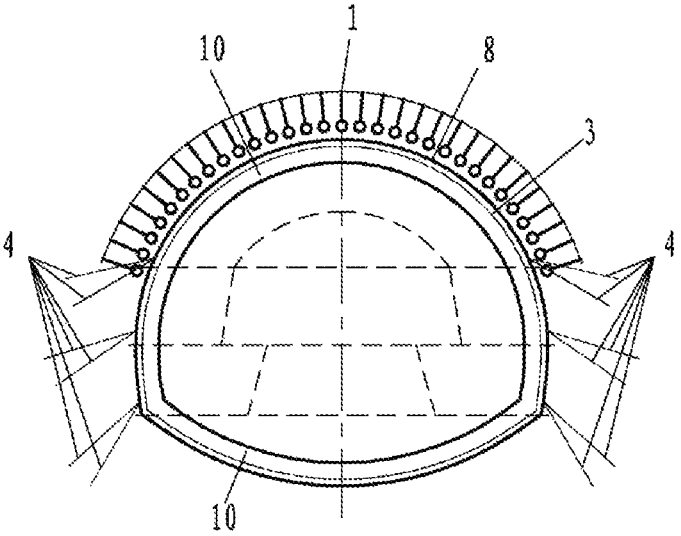
FIG. 8 is a diagram of corresponding tunnel support structure of zero large-deformation grade.

When the large deformation grade of large-span tunnel in chlorite schist stratum is zero large-deformation, as shown in FIG. 8, the corresponding control measure for zero large-deformation is:

Construct advance support: carrying out advance support by using Φ50 double-row advance grouting pipe 1 with a length of 3.5 m and a circumferential space of 40 cm;

Set reserved deformation: set the value of reserved deformation to be 10-20 cm;

Excavate the tunnel: excavating the tunnel by the method of three steps with reserving core soil;

Construct primary support: the arch, single-layer primary support is carried out for the arch, side wall and invert of the tunnel, wherein the primary support uses HW175-type steel frame 8 with an interval of 100 cm and C25 shotcrete 3 with a thickness of 28 cm, and the steel frame is set with a single-layer Φ8 steel mesh with the mesh space of 20×20 cm; and double-row Φ50 feet-lock pipes 4 with a length of 4 m are installed at the arch foot and the wall foot of the upper, middle and lower steps, and each truss of steel frame is installed with 24 feet-lock pipes;

Construct secondary lining: the secondary lining is made of C35 reinforced concrete 10, and the thickness of the secondary lining at the arch, side wall and tunnel invert is 60 cm, and the rebar in the secondary lining uses Φ25 rebar as the main reinforcement, and the space is 20 cm.

When the large deformation grade of large-span tunnel in chlorite schist stratum is zero large-deformation, the aforesaid control measure can be used to avoid the clearance intrusion caused by tunnel deformation and to ensure the safety and stability of the tunnel support structure, and the cost is controllable.

The invention claimed is:

1. A method for deformation control of large-span tunnel in chlorite schist stratum, comprising;

dividing a deformation of a large-span tunnel in chlorite schist stratum into five deformation grades according to surrounding rock conditions of the tunnel, wherein the five large deformation grades are extremely serious large-deformation, serious large-deformation, medium large-deformation, slight large-deformation, and zero large-deformation; and controlling a deformation of the large-span tunnel corresponding to one of the five deformation grades, wherein the extremely serious large-deformation comprises the tunnel surrounding rock being composed of single chlorite schist, having a saturated uniaxial compressive strength Rc<5 MPa, and being in a powder or granular structure;

wherein the serious large-deformation comprises the tunnel surrounding rock being composed of chlorite schist and contains 20% of quartz veins, containing underground water, having a saturated uniaxial compressive strength Rc of rock mass of 5-10 MPa, and having a rock mass integrity coefficient Kv≤0.15, and being in a cataclastic or granular structure;

wherein the medium large-deformation comprises the tunnel surrounding rock being composed of chlorite schist and containing less than 20% quartz veins, having no underground water, having a saturated uniaxial compressive strength Rc of rock mass of 10-20 MPa, having a rock mass integrity coefficient Kv of 0.15-0.35, and being in a thin stratified structure with a layer thickness less than 10 cm or a cataclastic structure;

wherein the slight large-deformation comprises the tunnel surrounding rock being composed of chlorite schist and containing large quartz veins with particle size greater than 5 cm, having no underground water, having a saturated uniaxial compressive strength Rc of rock mass of 20-25 MPa, having a rock mass integrity coefficient Kv of 0.35-0.55, and being in a thick stratified structure with a layer thickness greater than 10 cm or a blocky structure; and wherein the zero large-deformation comprises the tunnel surrounding rock being chlorite albite schist or other stratum with chlorite as a main part, having no underground water, having a saturated uniaxial compressive strength Rc of rock mass of equal or greater than 25 MPa, having a rock mass integrity coefficient Kv of 0.55-0.75, and being in a blocky structure.

2. The method for deformation control of large-span tunnel in chlorite schist stratum according to claim 1, wherein the large-span tunnel is single-hole highway tunnel with three lanes, or another tunnel with a same span as the single-hole highway tunnel with three lanes.

3. The method for deformation control of large-span tunnel in chlorite schist stratum according to claim 1, wherein controlling deformation comprises constructing advance support, setting reserved deformation, excavating the tunnel, constructing primary support, and constructing secondary lining.

4. The method for deformation control of large-span tunnel in chlorite schist stratum according to claim 3, wherein controlling deformation of large-span tunnel with different deformation grades is realized by controlling a row number of advance grouting pipes a value of reserved deformation, a distance from a bottom of the tunnel invert to a top surface of invert backfill during the excavation process, a model of and the space between the steel frames, a value of reserved deformation, a diameter and quantity of feet-lock pipes, and a thickness of shotcrete and secondary lining concrete of each layer of steel frames.

5. The method for deformation control of large-span tunnel in chlorite schist stratum according to claim 3, wherein controlling the extremely serious large-deformation of the large-span tunnel comprises:

constructing advance support using double-row advance grouting pipe;

setting reserved deformation to be 90-120 cm;

excavating the tunnel using a method of three steps with reserving core soil, wherein, when a tunnel invert is excavated, a distance from the bottom of the tunnel invert to a top surface of invert backfill is 3-4 m, which can improve a stress condition of the tunnel invert and effectively prevent cracking and heave of the tunnel invert;

constructing primary support, wherein double-layer primary supports are carried out in turn for the arch, side wall and invert of the tunnel, wherein the reserved deformation for the first-layer primary support is 90-120 cm, and the second-layer primary support is carried out when the reserved deformation has a remaining of 45-60 cm; and each layer of primary support uses HK200b-type steel frame with an interval of 50-60 cm and shotcrete with a thickness of 26-30 cm, and each layer of steel frame is installed with a double-layer steel mesh; and the arch foot and the wall foot of the upper, middle and lower steps of the first-layer steel frame are set with small-diameter double-row feet-lock pipes with a diameter ≤50 mm; and a large-diameter feet-lock pipe with a diameter ≥89 mm is set for each steel frame of the second layer at the arch foot and the wall foot of the middle and lower steps, and the installation angle of the feet-lock pipe is 20°-50°; and constructing secondary lining, wherein the secondary lining uses reinforced concrete with a thickness of 70-90 cm at the arch and the side wall, and reinforced concrete with a thickness of 70-100 cm in the tunnel invert.

6. The method for deformation control of large-span tunnel in chlorite schist stratum according to claim 3, wherein controlling the serious large-deformation of the large-span tunnel comprises:

constructing advance support by using double-row advance grouting pipe;

setting reserved deformation to be 50-90 cm;

excavating the tunnel using a method of three steps with reserving core soil, wherein the distance from the bottom of the tunnel invert to the top surface of invert backfill is 3-4 m;

constructing primary support, wherein double-layer primary supports are carried out in turn for the arch and side wall of the tunnel, wherein the reserved deformation for the first-layer primary support is 50-90 cm, and the second-layer primary support is carried out when the reserved deformation has a remaining of 25-45 cm; and single-layer primary support is applied to the tunnel invert; and each layer of primary support uses HK200b-type steel frame with an interval of 60-70 cm and shotcrete with a thickness of 26-30 cm, and each layer of steel frame is installed with a double-layer steel mesh; and the arch foot and the wall foot of the upper, middle and lower steps of the first-layer steel frame are set with small-diameter double-row feet-lock pipes with a diameter ≤50 mm; and a large-diameter feet-lock pipe with a diameter ≥89 mm is installed for every two steel frames of the second layer at the arch foot and the wall foot of the middle and lower steps; and the installation angle of the feet-lock pipe is 20°-50°; when the second-layer primary support is finished, the grouting pipe is used to carry out radial grouting reinforcement to the surrounding rock; and constructing secondary lining using reinforced concrete with a thickness of 70-90 cm at the arch and the side wall, and reinforced concrete with a thickness of 70-100 cm in the tunnel invert.

7. The method for deformation control of large-span tunnel in chlorite schist stratum according to claim 3, wherein controlling the medium large-deformation of the large-span tunnel comprises:

constructing advance support by using double-row advance grouting pipe;

setting reserved deformation to be 30-50 cm;

excavating the tunnel using a method of three steps with reserving core soil, wherein the distance from the bottom of the tunnel invert to the top surface of invert backfill is 3-4 m;

constructing primary support, wherein double-layer primary supports are carried out in turn for the arch and side wall of the tunnel, wherein the reserved deformation for the first-layer primary support is 30-50 cm, and the second-layer primary support is carried out when the reserved deformation has a remaining of 15-25 cm; and single-layer primary support is applied to the tunnel invert; and each layer of primary support uses HW175-type steel frame with an interval of 70-80 cm and shotcrete with a thickness of 26-30 cm, and each layer of steel frame is installed with a double-layer steel mesh; and the arch foot and the wall foot of the upper, middle and lower steps of the first-layer steel frame are set with small-diameter double-row feet-lock pipes with a diameter ≤50 mm; and a large-diameter feet-lock pipe with a diameter ≥89 mm is installed for every two steel frames of the second layer at the arch foot and the wall foot of the middle and lower steps; and the installation angle of the feet-lock pipe is 20°-50°; when the second-layer primary support is finished, the grouting pipe is used to carry out radial grouting reinforcement to the surrounding rock; and constructing secondary lining using reinforced concrete with a thickness of 70-90 cm at the arch, the side wall and the invert of the tunnel.

8. The method for deformation control of large-span tunnel in chlorite schist stratum according to claim 3, wherein controlling the slight large-deformation of the large-span tunnel comprises:

constructing advance support using double-row advance grouting pipe;

setting reserved deformation to be 20-30 cm;

excavating the tunnel using a method of three steps with reserving core soil, wherein the distance from the bottom of the tunnel invert to the top surface of invert backfill is 2.5-3 m;

constructing primary supports, wherein the arch, single-layer primary support is carried out for the arch, side wall and invert of the tunnel, wherein the primary support uses HK200b-type steel frame with an interval of 80-90 cm and shotcrete with a thickness of 26-30 cm, and the steel frame is set with a double-layer steel mesh; and the arch foot and the wall foot of the upper, middle and lower steps of the steel frame are set with small-diameter double-row feet-lock pipes with a diameter ≤50 mm, and the installation angle of the feet-lock pipe is 20°-50°; as for the replaced or twisted part of the steel frame, the grouting pipe is used to carry out radial grouting reinforcement to the surrounding rock; and constructing secondary lining using reinforced concrete with a thickness of 60-80 cm at the arch, the side wall and the invert of the tunnel.

9. The method for deformation control of large-span tunnel in chlorite schist stratum according to claim 3, wherein controlling the zero large-deformation of the large-span tunnel comprises:

constructing advance support using double-row advance grouting pipe;

setting reserved deformation to be 10-20 cm;

excavating the tunnel using a method of three steps with reserving core soil;

constructing primary support, wherein single-layer primary support is carried out for the arch, side wall and invert of the tunnel, wherein the primary support uses HW175-type steel frame with an interval of 90-100 cm and shotcrete with a thickness of 26-28 cm, and the steel frame is set with a double-layer steel mesh; and the arch foot and the wall foot of the upper, middle and lower steps of the steel frame are set with small-diameter double-row feet-lock pipes with a diameter ≤50 mm, and the installation angle of the feet-lock pipe is 20°-50°; and constructing secondary lining using reinforced concrete with a thickness of 60-80 cm at the arch, the side wall and the invert of the tunnel.

* * * * *